US008470399B1

(12) United States Patent
Lewis

(10) Patent No.: US 8,470,399 B1
(45) Date of Patent: Jun. 25, 2013

(54) BEAD PROCESSING SYSTEM

(76) Inventor: Barbara A. Lewis, Bushwood, MD (US)

( * ) Notice: Subject to any disclaimer, the term of this patent is extended or adjusted under 35 U.S.C. 154(b) by 253 days.

(21) Appl. No.: 13/065,197

(22) Filed: Mar. 16, 2011

(51) Int. Cl.
*B05D 3/08* (2006.01)

(52) U.S. Cl.
USPC ..... 427/223

(58) Field of Classification Search
USPC ..... 427/223; 118/500, 502
See application file for complete search history.

(56) References Cited

U.S. PATENT DOCUMENTS

| | | | | |
|---|---|---|---|---|
| 3,027,607 | A | 5/1958 | Badger et al. | |
| 4,209,556 | A | 6/1980 | Brandeberry et al. | |
| 4,372,993 | A * | 2/1983 | Seidel et al. | 427/193 |

OTHER PUBLICATIONS

Keggan, Cheryl. Enamel Beads with Propane Torch, 1999, www.dragonbeads.com/enamel.html. Accessed Apr. 15, 2013.*

Barbara Lewis; Jewelry of Distinction; website URL: http://jewelryofdistinction.blogspot.com/2009_11_19_archive.html; posted Nov. 19, 2009.

Barbara Lewis; Day Into Night; Belle Armoire Jewelry; Winter 2010 edition; published prior to Feb. 1, 2010.

* cited by examiner

*Primary Examiner* — Kelly M Gambetta
(74) *Attorney, Agent, or Firm* — www.bobharter.com; Robert J. Harter

(57) ABSTRACT

An enamel bead-making system involves a novel bead-pulling station and a mandrel (slender rod). The mandrel is for manually dipping a preheated metal bead core into a container of glass powder so that the powder melts and later solidifies on the core, thereby creating an enamel or glass coated bead. To safely remove the hot enamel bead from the mandrel, the mandrel is manually pulled through a V-notch in an upper edge of the bead-pulling station, which forces the bead off the end of the mandrel and into a collection area for cooling. A second V-notch allows a subsequent bead to be removed and cooled at a location spaced apart from the first one. If a bead sticks on the mandrel, the mandrel can be pushed through a small hole in the bead-pulling station, which helps break a glass bond that might develop between the mandrel and the enamel bead.

9 Claims, 10 Drawing Sheets

34
10
18
32
22
54
56
46
20
12"
26
28
32
24
30

20
36
14
34
16

38
14
20
32

34

14
28
20

FIG. 14
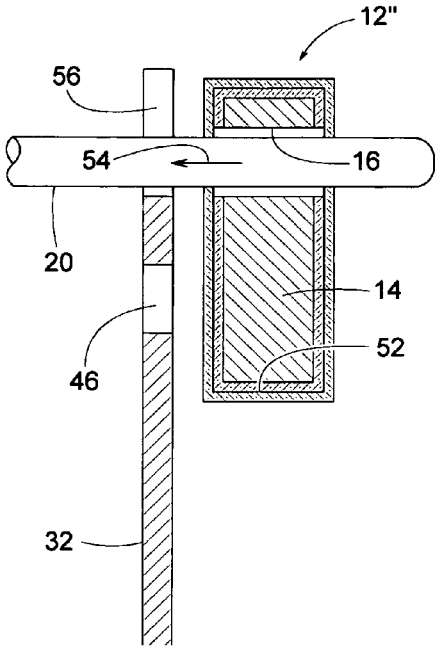
FIG. 15
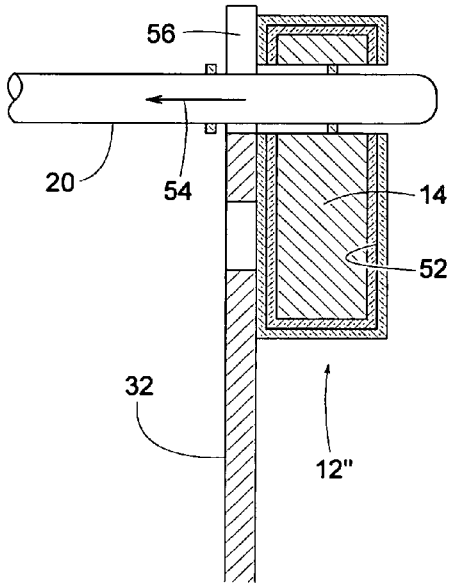
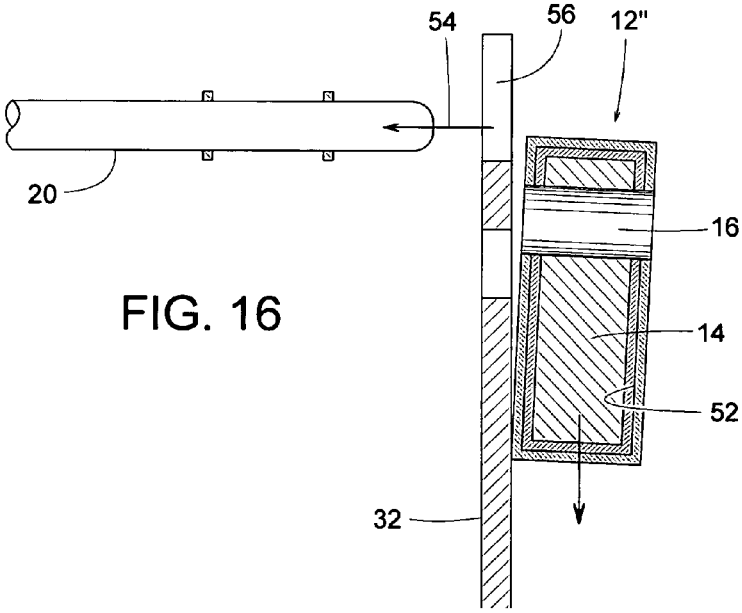
FIG. 16

BEAD PROCESSING SYSTEM

FIELD OF THE INVENTION

The subject invention generally pertains to a system for making enamel coated beads and more specifically to means for efficiently removing hot enamel coated beads from a handheld mandrel.

BACKGROUND

Enamel is generally a glass coating on a core or base material. An enamel process might involve coating the base material with glass powder and then heating the coated material in a kiln to melt the powder, thereby rendering the base material covered with a layer of glass. Another enamel method is disclosed in U.S. Pat. No. 4,372,993, wherein the base material is heated prior to covering it with enamel powder.

BRIEF DESCRIPTION OF THE DRAWINGS

FIG. 14 is a cross-sectional side view showing details of the bead as it is pulled toward the V-notch.

FIG. 15 is a cross-sectional side view similar to FIG. 14 but showing details of the bead as the mandrel is pulled further through the V-notch.

FIG. 16 is a cross-sectional side view similar to FIGS. 14 and 15 but showing the bead dropping as the bead is forced off the end of the mandrel.

DESCRIPTION OF THE PREFERRED EMBODIMENT

FIGS. 1-22 illustrate an example bead-pulling system 10 and method for creating an enamel coated bead 12". The term, "enamel," as used herein and throughout this patent, means glass or ceramic. Bead 12" comprises a core 14 that can be of any shape and size. Some example materials of core 14 include, but are not limited to, iron, brass, silver, gold, copper and steel. In some examples, bead 12" includes a core hole 16 for handling and for possible later integration with a finished product (e.g., jewelry).

Figure 1:
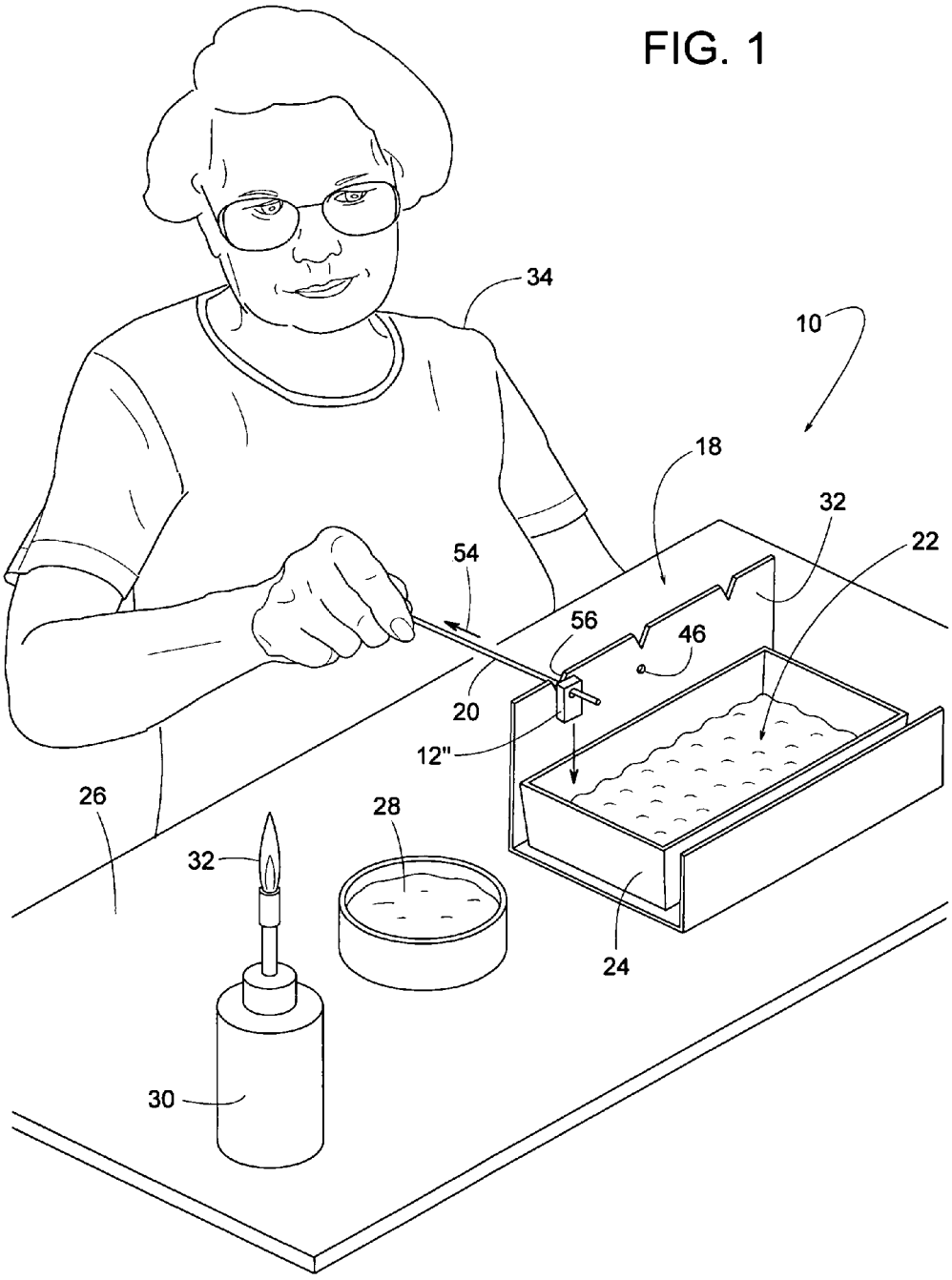
FIG. 1 is a perspective view of a person having a wonderful time using one example of a bead-pulling system.

Although the specific construction, layout and use of bead-pulling system 10 may vary, FIG. 1 provides an example comprising a bead-pulling station 18, a bead-supporting mandrel 20, a bead-collection area 22 (e.g., a pan 24), a base 26 (e.g., tabletop, cookie sheet, cutting board, etc.), a collection of enamel particulate 28 (e.g., glass powder in an open container), and a torch 30 providing a flame 32 sufficiently hot to exceed the melting temperature of the chosen enamel particulate 28. Examples of torch 30 include, but are not limited to, a propane torch or one fueled by MAPP gas (MAPP being a trademark of Petromont). Bead-pulling station 18 includes a plate 32 (e.g., plate being separate or integral with the rest of station 18) designed for assisting in the removal of bead 12" from mandrel 20.

Figure 2:
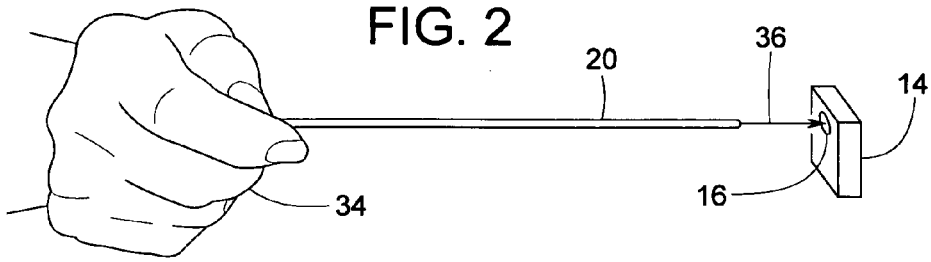
FIG. 2 is a perspective view of an example mandrel being inserted in one example of a bead core.

One example method of a person 34 using bead-pulling system 10 follows the sequence of FIGS. 2, 3, 4, 5, 6, 10, 11, 12, 13 and 17; in that order. Arrow 36 of FIG. 2 represents person 34 manually inserting mandrel 20 through hole 16 of core 14.

Figure 3:
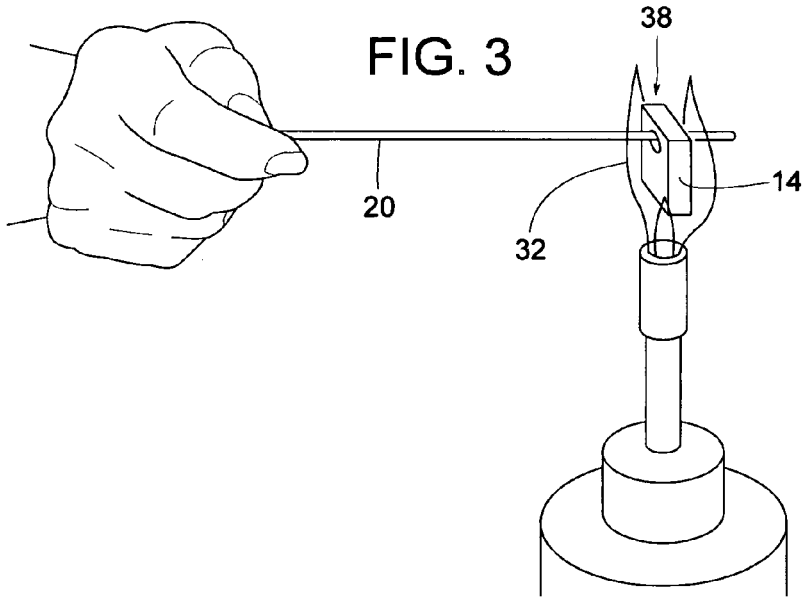
FIG. 3 is a perspective view of the bead core of FIGS. 1 and 2 being heated in a flame.

FIG. 3 shows person 34 supporting core 14 at a first location 38 (FIG. 7) on mandrel 20 and heating core 14 by immersing core 14 in flame 32.

Figure 4:
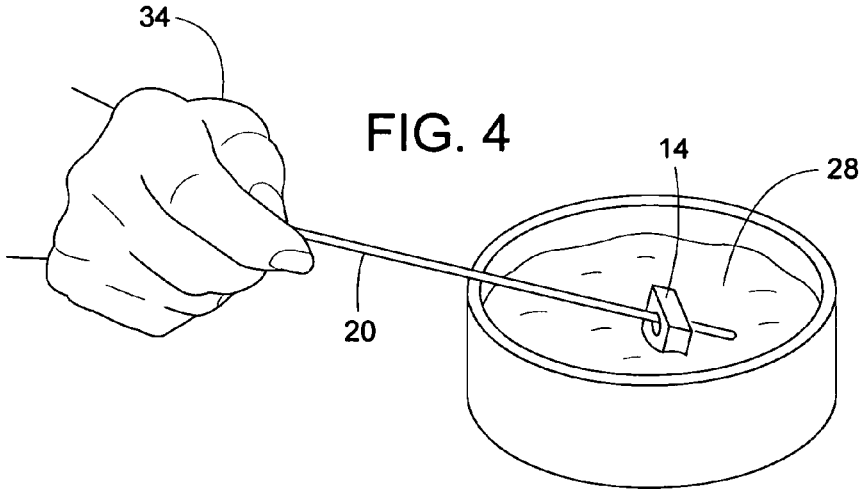
FIG. 4 is a perspective view of the currently hot bead core being dipped and ultimately immersed in a collection of glass powder.

FIG. 4 illustrates that after core 14 is sufficiently hot to melt enamel particulate 28 (e.g., glowing hot), person 34 dips core 14 in the collection of enamel particulate 28, thereby melting a first layer 40 of enamel onto core 14, thereby creating a bead 12' with one enamel coating 40. In some examples, the dipping process involves completely burying core 14 in enamel particulate 28. Completely immersing core 14 in particulate 28 provides a relatively even enamel coat on core 14, even in cases where core 14 is neither round nor cylindrical. Without complete immersion, an alternate rolling process (for round or cylindrical cores) might allow a shallow collection of enamel particulate to begin prematurely cooling portions of the core before the entire core is coated. The term, "immerse," and derivatives thereof mean that an item is completely covered or buried under loose particulate or engulfed within a flame.

Figure 5:
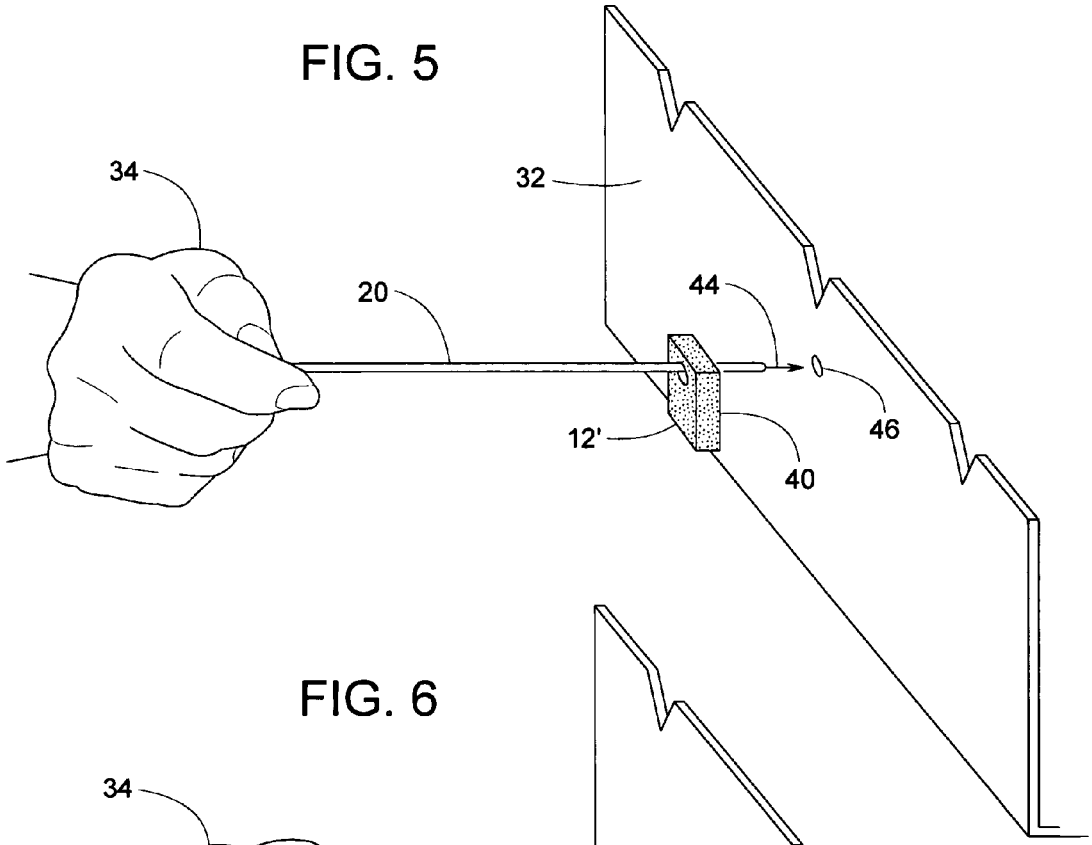
FIG. 5 is a perspective view of the mandrel being inserted in a hole in an example plate of an example bead-pulling station.
Figure 6:
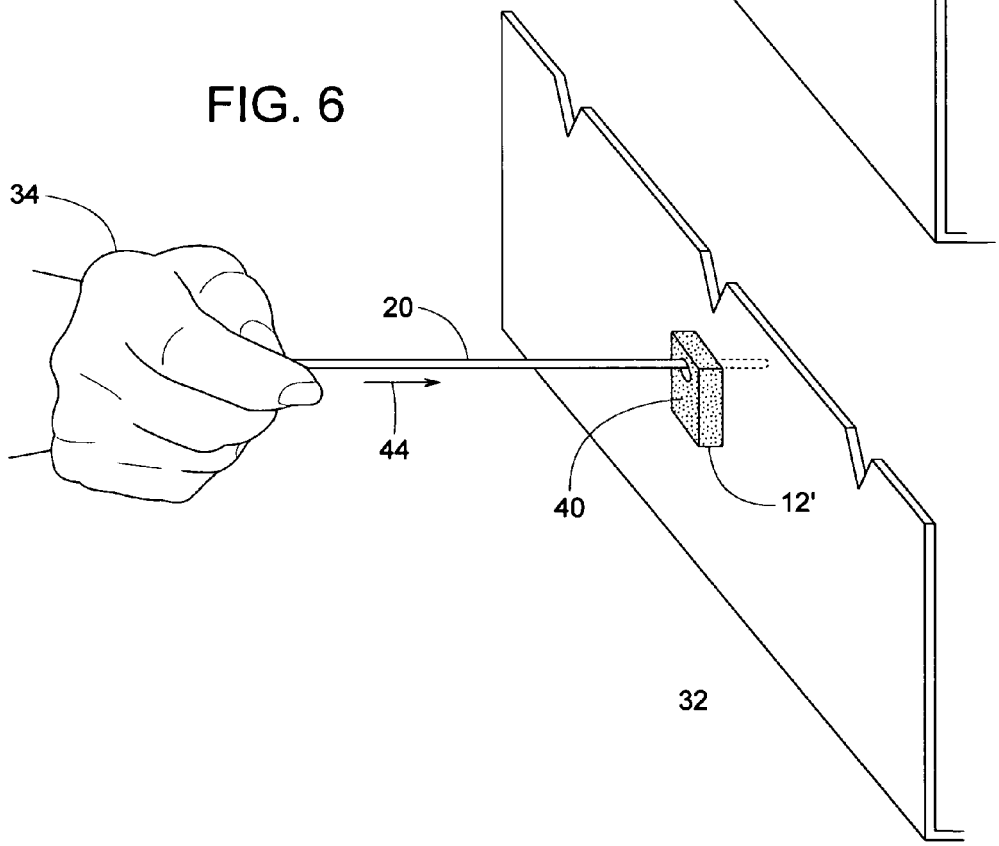
FIG. 6 is a perspective view of the mandrel being pushed through the hole in the plate.
Figure 7:
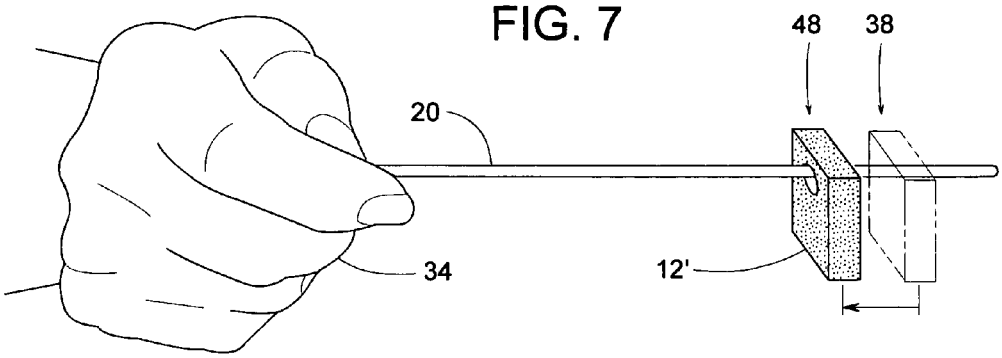
FIG. 7 is a perspective view showing the displacement of the bead as a result of the pushing action illustrated in FIG. 6.
Figure 8:
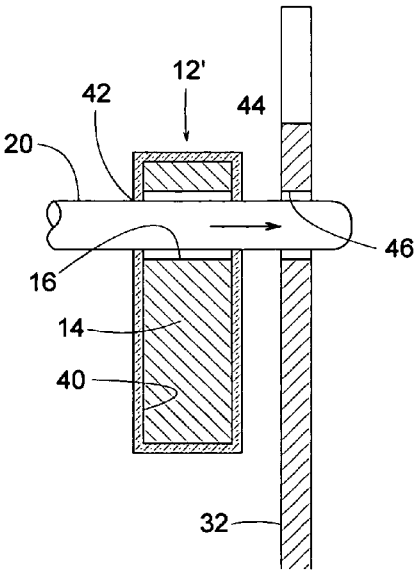
FIG. 8 is a side cross-sectional view showing details of the bead it approaches the plate.
Figure 9:
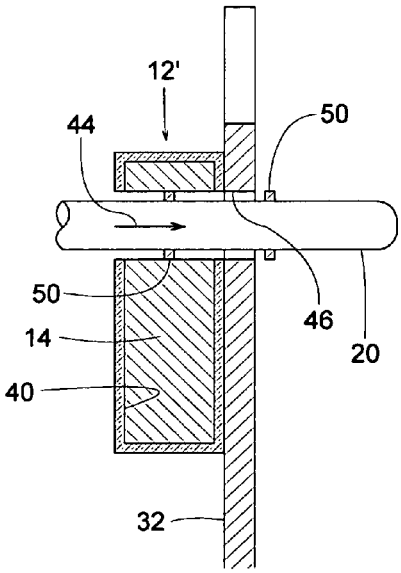
FIG. 9 is a side cross-sectional view similar to FIG. 8 but showing details of the bead as the mandrel is pushed further through the hole in the plate.

FIGS. 5-9 illustrate a means for breaking a bond 42 (FIG. 8) caused by molten enamel sticking and solidifying to mandrel 20. FIGS. 5 and 6 show person 34 manually pushing mandrel 20 in a forward direction 44 through a mandrel-receiving hole 46 in plate 32 of bead-pulling station 18, thereby pushing core 14 with the first enamel layer 40 to a second location 48 (FIG. 7) on mandrel 20. Pushing mandrel 20 through hole 46, as shown in FIG. 6, effectively moves bead 12' (core 14 with one enamel coating 40) from position 38 to position 48, as shown in FIG. 7. FIG. 8 shows some enamel bonded to mandrel 20. FIG. 9 shows bond fragments 50 having separated from enamel coated core 14 as a result of pushing mandrel 20 through hole 46. Breaking or otherwise disrupting bond 42 makes bead 12' easier to reposition on mandrel 20 and easier to remove later.

Figure 10:
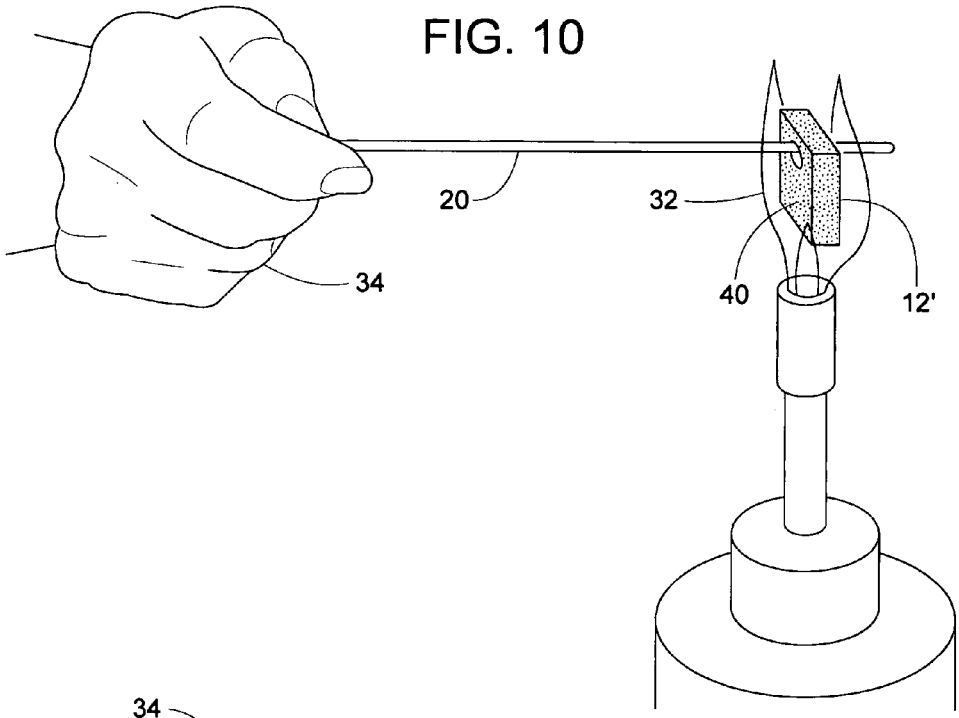
FIG. 10 is a perspective view similar to FIG. 3 but showing the flame heating the bead with a first layer of glass coating.
Figure 11:
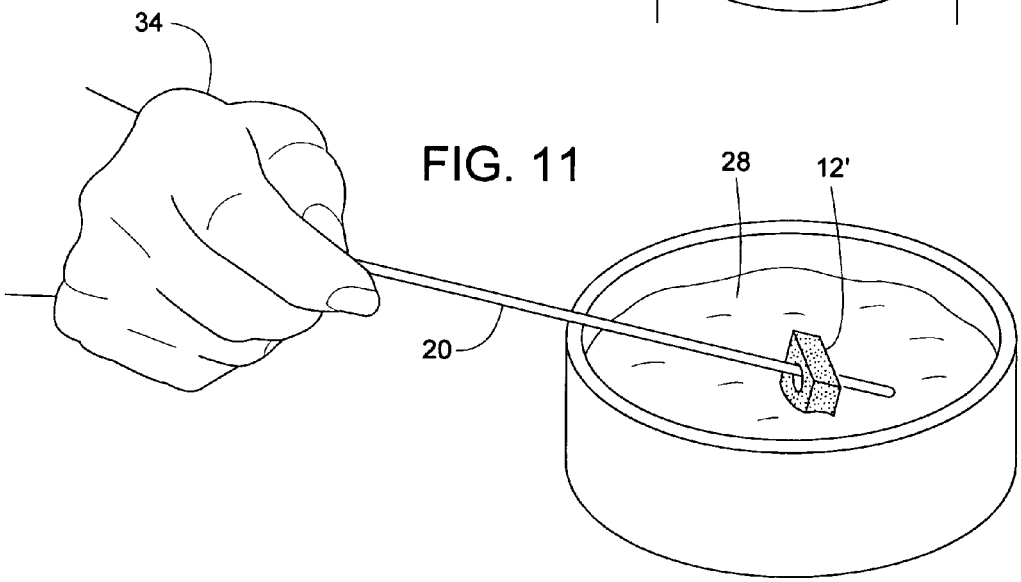
FIG. 11 is a perspective view similar to FIG. 4 but showing the bead being dipped and ultimately immersed in the glass powder to apply a second layer of enamel.

To create a bead 12" with two enamel layers, referring to FIGS. 10 and 11, core 14 (bead 12') can be coated with a second enamel layer 52 by basically repeating the actions illustrated in FIGS. 3 and 4, wherein FIGS. 10 and 11 correspond to FIGS. 3 and 4 respectively. In some examples, core 14 is coated with any number of enamel layers by repeating the sequence illustrated in FIGS. 3, 4, 5 and 6 and any reasonable number of times. FIG. 10 illustrates heating core 14 and the first enamel layer 40 in flame 32 (heating bead 12'). FIG. 11 illustrates immersing core 14 and first enamel layer 40 (bead 12) in the collection of enamel particulate 28, thereby melting second layer 52 of enamel 28 onto the first enamel layer 40 to create bead 12".

Figure 12:
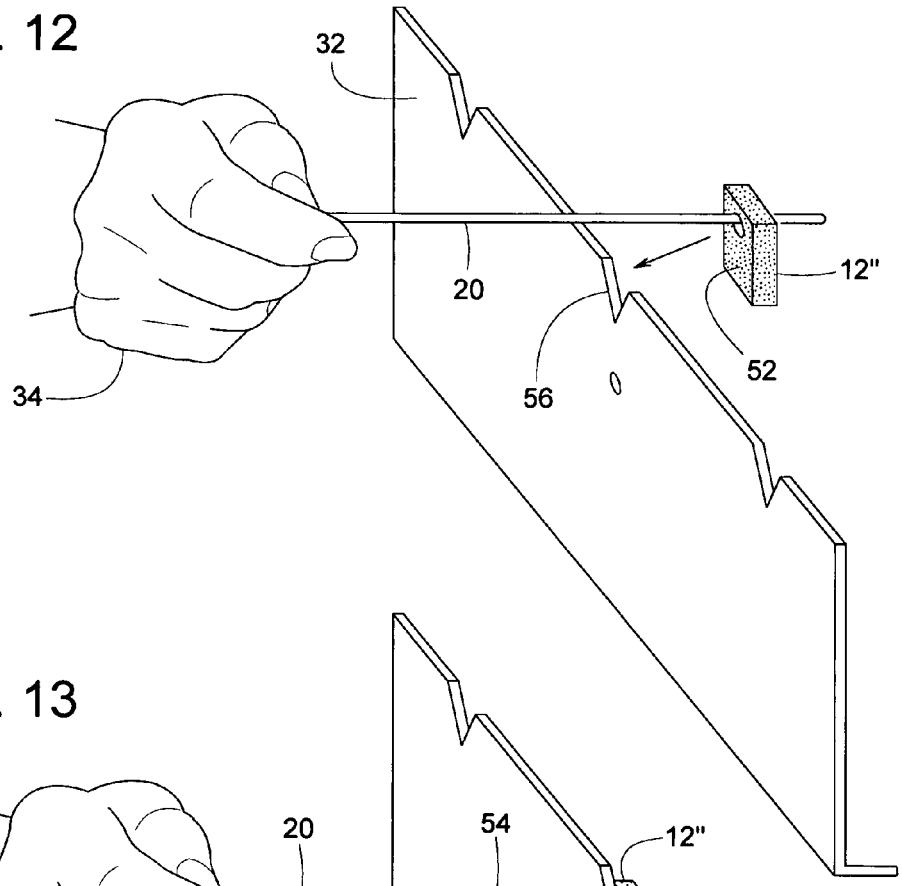
FIG. 12 is a perspective view showing the mandrel moving a glass coated bead toward a V-notch in a plate of the bead-pulling station.
Figure 13:
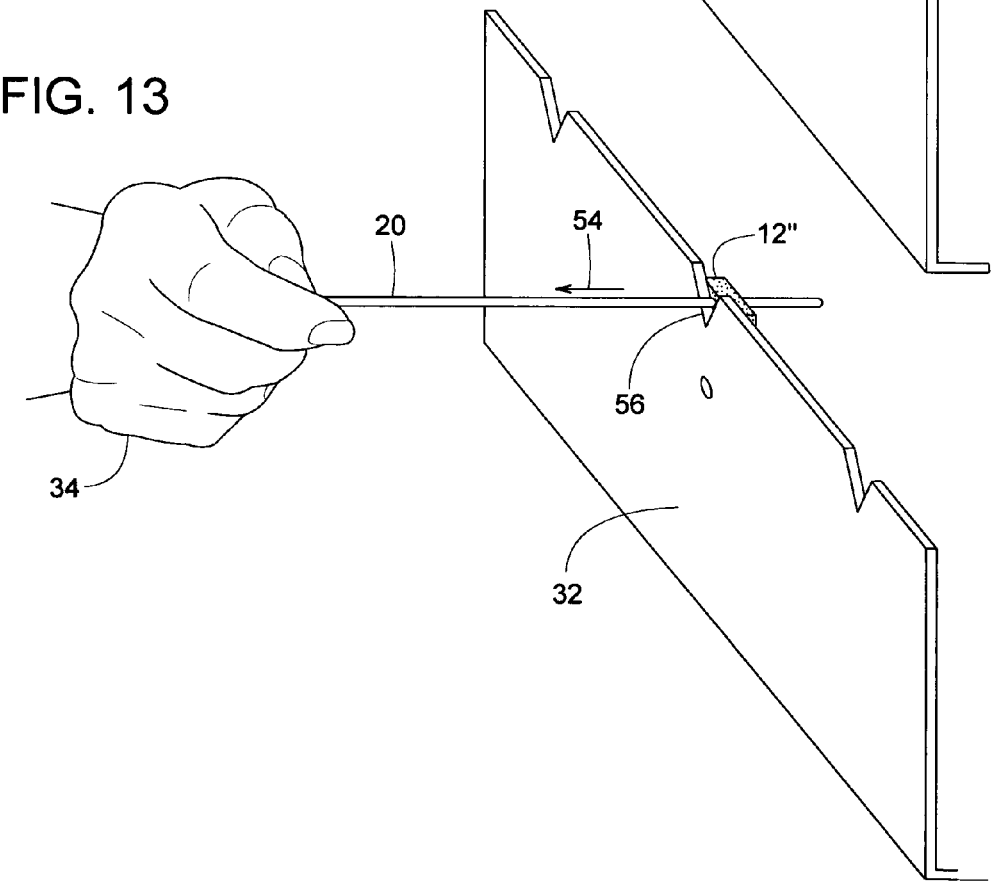
FIG. 13 is a perspective view showing the bead being forced off the end of mandrel by pulling the mandrel through the V-notch.
Figure 17:
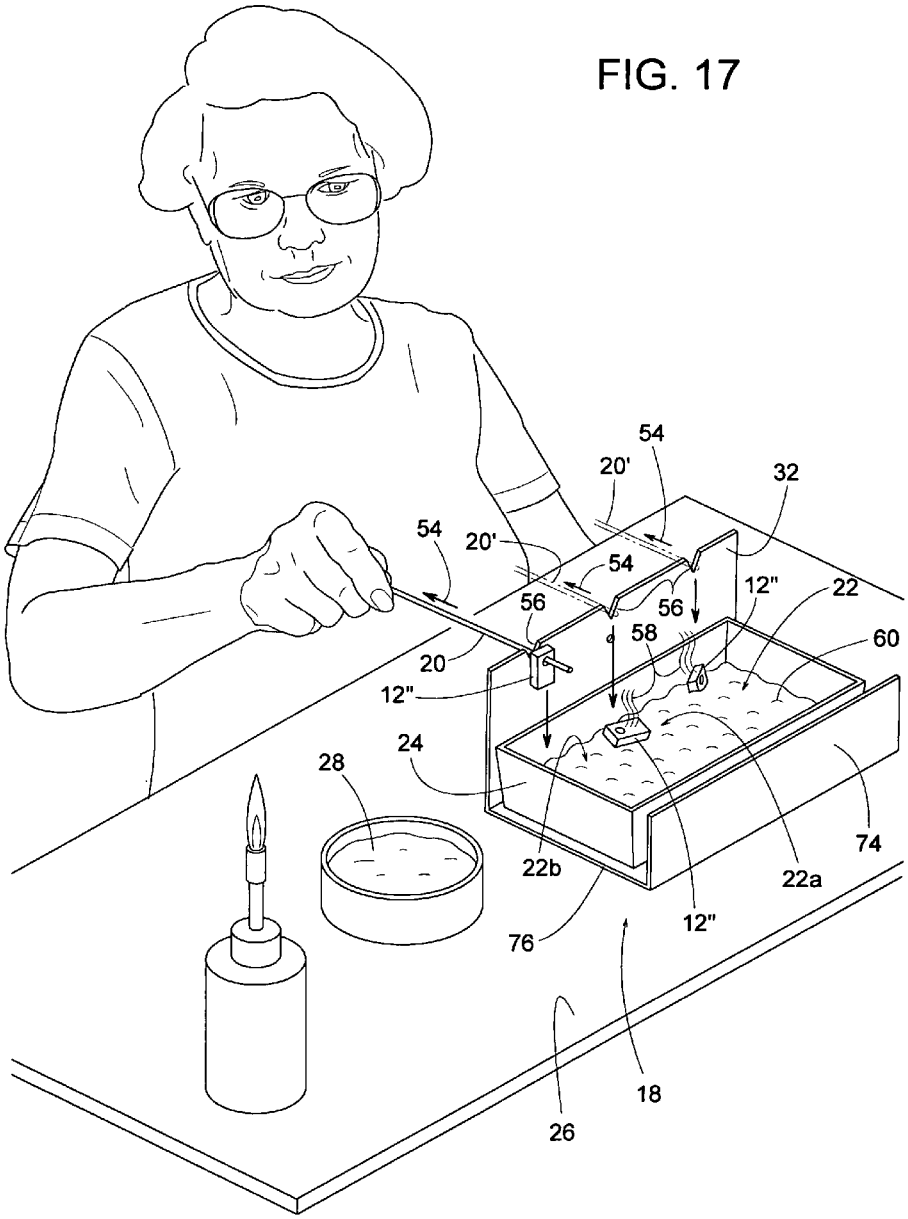
FIG. 17 is a perspective view similar to FIG. 1 but showing multiple beads having been dropped into separate collection areas for cooling.
Figure 18:
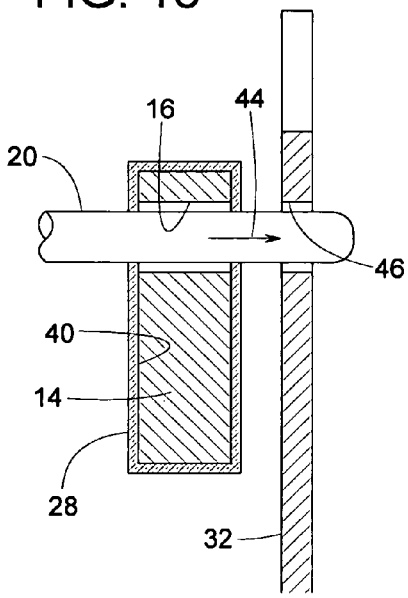
FIG. 18 is a cross-sectional side view similar to FIG. 8 but with the bead's enamel coating being partially soft.
Figure 19:
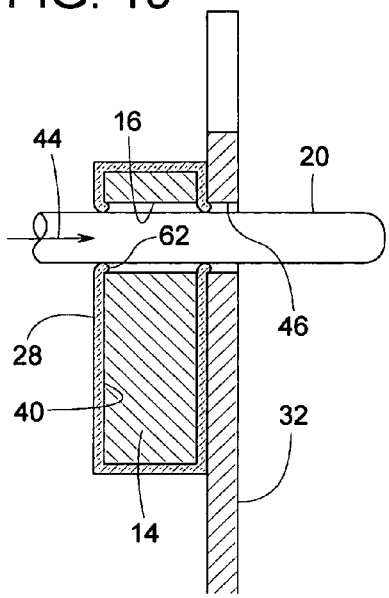
FIG. 19 is a cross-sectional side view similar to FIG. 9 but showing the some of the enamel coating being drawn into the bead's core hole.
Figure 20:
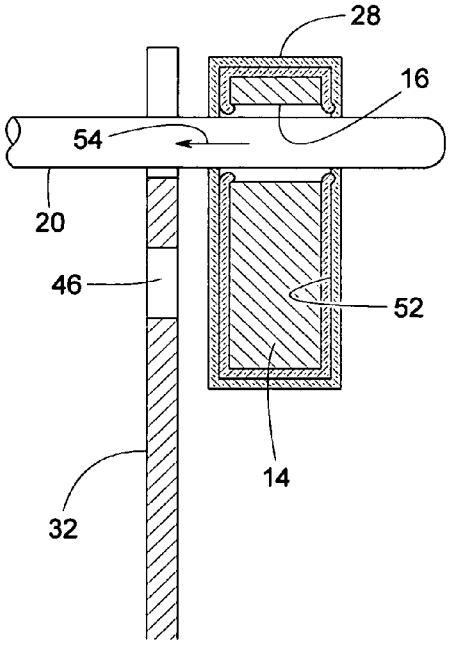
FIG. 20 is a cross-sectional side view similar to FIG. 14 but with the bead's second layer of enamel being partially soft.
Figure 21:
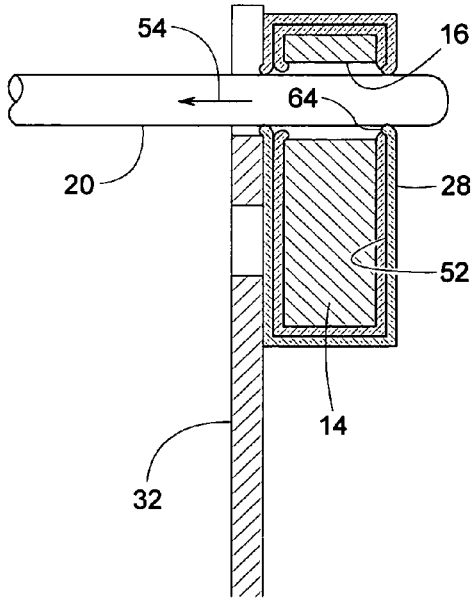
FIG. 21 is a cross-sectional side view similar to FIG. 15 but showing some of the bead's second layer of enamel being drawn in the bead's core hole.

Once core 14 is coated with a desired number of enamel layers (two layers in this example), the bead 12" can be removed from mandrel 20, as shown in FIGS. 12-17. FIG. 12 shows person 34 manually pulling mandrel 20 in a reverse direction 54 across a first notch 56 defined by plate 32 of bead-pulling station 18, thereby forcing core 14 with first enamel layer 40 and second enamel layer 52 off of mandrel 20 (i.e., forcing bead 12" off of mandrel 20). FIGS. 13, 16 and 17 illustrate the action of dropping core 14 with first enamel layer 40 and second enamel layer 52 onto a first collection area 22*a* of bead-collection area 22 (area 22*a* being shown in FIGS. 17 and 22).

When additional beads 12" are to being made, coating a second core 14 with enamel is done in a manner similar to that of the first one, so that action has already been illustrated and described. However, to avoid two relatively hot beads 12" from sticking to each other while cooling in bead collection area 22, person 34, while making the second bead 12", manually pulls mandrel 20 in the reverse direction 54 across a second notch 56 defined by plate 32 of bead-pulling station 18, thereby forcing second enamel coated core 14 off mandrel 20. The step of pulling the second bead 12" off mandrel 20 at a second notch 56 is represented in FIG. 17 by arrow 54 adjacent phantom mandrel lines 20', as compared to arrow 54 adjacent mandrel 20. Also, FIGS. 1 and 13 show mandrel 20 being pulled across two different notches 56, either one of which can be considered the first notch while the other one a second notch.

Vertical arrows in FIG. 17 show the action of dropping the second enamel coated core 14 (bead 12") onto a second collection area 22*b* of bead-collection area 22, wherein the first notch 56 is spaced apart from the second notch 56 (equivalent notches spaced apart). In some examples, first collection area 22*a* is underneath the first notch 56, and the second collection area 22*b* is underneath the second notch 56. Radiant lines 58 illustrate cooling of the first core and the second core (i.e., cooling multiple beads 12") in bead-collection area 22 while ensuring separation between the first core and the second core (separation between two beads 12" in area 22. It should be noted that the term, "underneath," as it pertains to "an area being underneath a notch," means that a bead falling from the general vicinity of the notch would tend to fall or tumble into said area. In some examples, bead-collection area 22 includes a bed of heat resistant vermiculite granules 60 to support beads 12" as they cool.

In addition or as alternative to the bond-disrupting actions illustrated in FIGS. 8, 9, 14 and 15, in some examples, the actions shown in FIGS. 18-21 are used for drawing at least some enamel into core hole 16. Examples of such drawn-in enamel are shown at points 62 and 64. The pushing and pulling actions shown in FIGS. 18, 19, 20 and 21; which correspond to FIGS. 8, 9, 14 and 15 respectively; are performed while the enamel coatings 40 and/or 52 are still somewhat soft. With enamel layers 40 and/or 52 being at least partially molten, soft enamel can be drawn into core hole 16, which helps coat the core hole's edges that might otherwise be exposed or left with a sharp edge.

Figure 22:
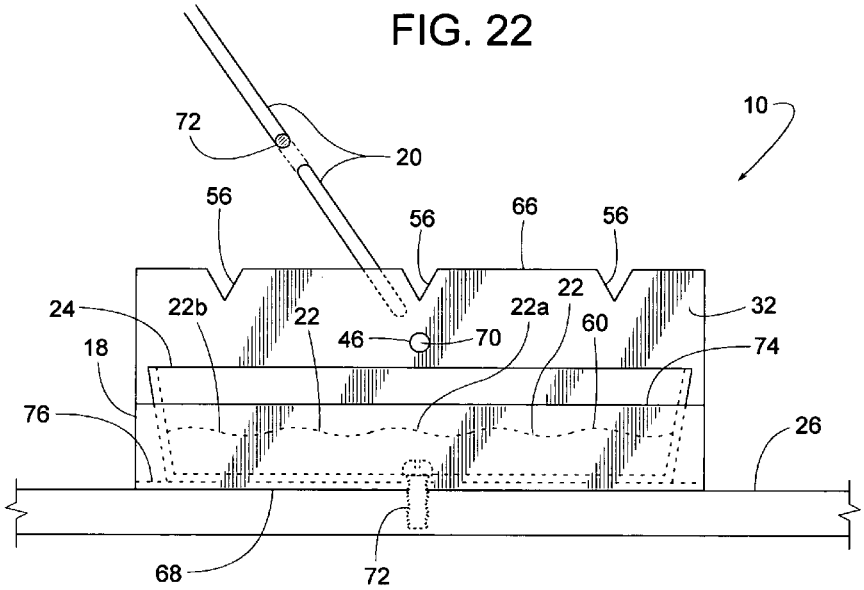
FIG. 22 is a back view of an example bead-pulling system that shows a cross-section of the mandrel.
Figure 23:
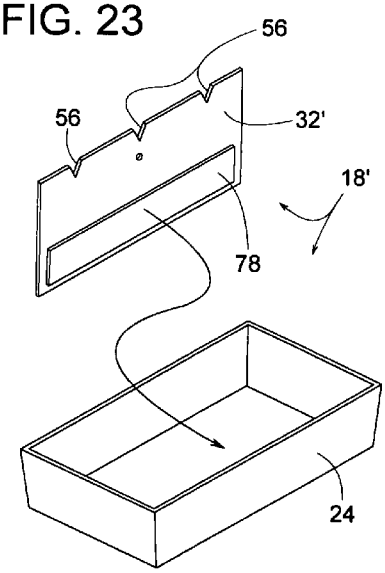
FIG. 23 is an exploded perspective view of another example bead-pulling station.
Figure 24:
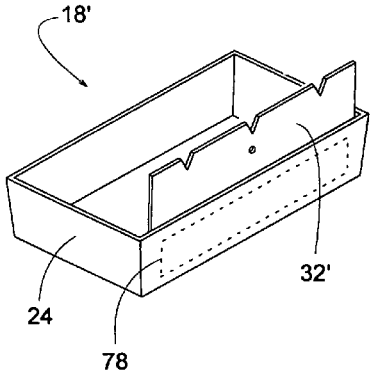
FIG. 24 is a perspective view of the bead-pulling station of FIG. 23, wherein the bead-pulling station is shown assembled.

Some structural examples of bead-pulling system 10 are shown in FIGS. 22-24. FIG. 22, for example, shows plate 32 of bead-pulling station 18 comprising an upper edge 66 and a lower edge 68 (e.g., lowermost surface of station 18), wherein upper edge 66, in some examples, defines two or more notches 56. Notches 56 are space apart to alternatingly receive mandrel 20 in the notches (i.e., first notch for ejecting the first mandrel-supported bead, the second notch for ejecting the second mandrel-supported bead). Mandrel-receiving hole 46 in plate 32 is between edges 66 and 68 and has an open area 70 that is greater than a cross-sectional area 72 of mandrel 20 (e.g., mandrel 20 slidingly fits in hole 46). In some examples, cross-sectional area 72 has an outer diameter that is smaller than the inner diameter of core hole 16. This ensures that after a first enamel bead is made and after mandrel 20 has been pushed through mandrel-receiving hole 46, mandrel 20 will be scraped sufficiently clean to readily fit into the next bead's core hole 16.

In the example of FIG. 22, bead-collection area 22 is in the form of open container 24 (e.g., a bread loaf pan) in proximity with plate 32 and is below upper edge 66. In this example, bead-collection area 22 includes at least one collection area 22*a* underneath one notch 56 and another collection area 22*b* underneath another notch 56.

To resist pushing and pulling forces that mandrel 20 exerts against plate 32, in some examples, one or more fasteners 72 (screw, nail, adhesive, VELCRO, etc.) holds one or more components of system 10 in place. In some examples, fastener 72 holds plate 32 and container 24 anchored relative to each other. The expression, "anchored relative to each other" means one item is held substantially stationary with respect to a second item. In some examples, fastener 72 holds plate 32 to base 26. In some examples, fastener 72 holds container 24 to base 26. In some examples, fastener 72 holds both plate 32 and container 24 to base 26. In some examples, bead-pulling station 18 includes a back plate 74 that in combination with plate 32 and a bottom plate 76 define a channel in which container 24 can be installed and held in place.

In the example shown in FIGS. 23 and 24, a bead-pulling station 18' comprises a plate 32' with a plurality of notches 56 plus a fastener 78 for attaching plate 32' to container 24, thereby eliminating bottom plate 76 and back plate 74, which might reduce the manufacturing and shipping costs of the bead-pulling station. In some examples, plate 32' extends into container 24. Fastener 78 is schematically illustrated to represent any means for attaching plate 32' to container 24 such that the two are substantially stationary relative to each other. Examples of fastener 78 include, but are not limited to, a magnet, adhesive, double-sided tape, VELCRO, and various combinations thereof. In some examples, plate 32' is made of aluminum, and container 24 is made of steel; however, in other examples, plate 32' and container 24 are made of a wide variety of other materials. In some examples, fastener 78 comprises an adhesive-backed magnet, wherein the adhesive holds the magnetic to plate 32' (made of aluminum), and the magnet sticks to container 24 (made of steel).

Example plates 32 and 32' of bead-pulling stations 18 and 18' are illustrated as generally flat sections of sheet material; however, the term "plate," as it pertains to plates 32, 32' and other examples thereof, broadly encompasses other shapes and forms including, but not limited to a bar, rod, etc. In some examples of bead-pulling stations 18 and 18', notches 56 are V-shaped to ensure broadly distributed contact with mandrel 20, regardless of some diametric variation in mandrel 20. In some examples, mandrel 20 is comprised of a solid rod made of metal (e.g., steel, INCONEL (trademark of Special Metals Corp.) stainless steel, etc.), so that mandrel 20 is less likely to melt under the heat of flame 32. In some examples, mandrel 20 is coated with a non-stick lubricant, such as molybdenum disulfide. In some examples, at least an end portion of mandrel 20 is a hollow tube so that after mandrel 20 is removed from flame 32, the tubular portion of mandrel 20 cools faster than core 14 so that enamel layers 40 and 52 are less prone to melt onto that portion of mandrel 20.

Additional related and possibly helpful background information, such as product and process ideas, might be found in U.S. Pat. No. 4,372,993; which is specifically incorporated by reference herein.

Although the invention is described with respect to a preferred embodiment, modifications thereto will be apparent to those of ordinary skill in the art. The scope of the invention, therefore, is to be determined by reference to the following claims:

The invention claimed is:

1. A method for creating a bead that includes a core coated with an enamel, the method involving the use of a collection of enamel particulate, a bead-supporting mandrel, a flame, a bead-collection area, and a bead-pulling station that includes a plate, the method comprising:

supporting the core at a first location on the bead-supporting mandrel by inserting the bead-supporting mandrel through a core hole of the core;

heating the core by immersing the core in the flame;

dipping the core in the collection of enamel particulate, thereby melting a first layer of enamel onto the core;

manually pushing the bead-supporting mandrel in a forward direction across the plate of the bead-pulling station, thereby pushing the core with the first layer of enamel to a second location on the bead-supporting mandrel;

heating the core and the first layer of enamel in the flame;

dipping the core and the first layer of enamel in the collection of enamel particulate, thereby melting a second layer of enamel onto the first layer of enamel;

manually pulling the bead-supporting mandrel in a reverse direction across the plate of the bead-pulling station, thereby forcing the core with the first layer of enamel and the second layer of enamel off the bead-supporting mandrel; and dropping the core with the first layer of enamel and the second layer enamel onto the bead-collection area.

2. The method of claim 1, wherein manually pushing the bead-supporting mandrel in the forward direction across the plate involves pushing the bead-supporting mandrel through a mandrel-receiving hole in the plate.

3. The method of claim 1, wherein an upper edge of the plate defines a first notch and a second notch that are horizontally spaced apart from each other, the bead-collection area includes a first collection area underneath the first notch and a second collection area underneath the second notch, wherein manually pulling the bead-supporting mandrel in the reverse direction across the plate involves dragging the bead-supporting mandrel selectively across at least one of the first notch and the second notch, thereby selectively dropping the core with the first layer of enamel and the second layer enamel onto at least one of the first collection area and the second collection area.

4. The method of claim 1, further comprising:

dropping the core with the first layer of enamel and the second layer enamel onto the first collection area;

dropping a second core with an enamel coating onto the second collection area; and cooling the core and the second core while maintaining separation therebetween.

5. The method of claim 1, further comprising:

creating a first bond between the first layer of enamel and the bead-supporting mandrel; and disrupting the first bond by manually pushing the bead-supporting mandrel in the forward direction across the plate of the bead-pulling station.

6. The method of claim 5, further comprising:

creating a second bond between the second layer of enamel and the bead-supporting mandrel; and disrupting the second bond by manually pulling the bead-supporting mandrel in the reverse direction across the plate of the bead-pulling station.

7. The method of claim 1, further comprising drawing at least some enamel into the core hole by manually pushing the bead-supporting mandrel in the forward direction across the plate of the bead-pulling station.

8. The method of claim 1, further comprising drawing at least some enamel into the core hole by manually pulling the bead-supporting mandrel in the reverse direction across the plate of the bead-pulling station.

9. A method for creating a bead that includes a core coated with an enamel, the method involving the use of a collection of enamel particulate, a bead-supporting mandrel, a flame, a bead-collection area, and a bead-pulling station that includes a plate, the method comprising:

supporting a first core at a first location on the bead-supporting mandrel by inserting the bead-supporting mandrel through a core hole of the first core;

heating the first core by immersing the first core in the flame;

dipping the first core in the collection of enamel particulate, thereby melting a first layer of enamel onto the first core;

manually pushing the bead-supporting mandrel in a forward direction through a mandrel-receiving hole in the plate of the bead-pulling station, thereby pushing the first core with the first layer of enamel to a second location on the bead-supporting mandrel;

heating the first core and the first layer of enamel in the flame;

dipping the first core and the first layer of enamel in the collection of enamel particulate, thereby melting a second layer of enamel onto the first layer of enamel;

manually pulling the bead-supporting mandrel in a reverse direction across a first notch defined by the plate of the bead-pulling station, thereby forcing the first core with the first layer of enamel and the second layer of enamel off the bead-supporting mandrel;

dropping the first core with the first layer of enamel and the second layer enamel onto a first collection area of the bead-collection area;

coating a second core with enamel in a manner similar to that of the first core;

manually pulling the bead-supporting mandrel in the reverse direction across a second notch defined by the plate of the bead-pulling station, thereby forcing the second core with enamel off the bead-supporting mandrel;

dropping the second core with enamel onto a second collection area of the bead-collection area, wherein the first notch is spaced apart from the second notch, the first collection area is underneath the first notch, and the second collection area is underneath the second notch; and cooling the first core and the second core in the bead-collection area while maintaining separation between the first core and the second core.

* * * * *